US006622722B2

(12) United States Patent
Chen-Lieh

(10) Patent No.: US 6,622,722 B2
(45) Date of Patent: Sep. 23, 2003

(54) WATER PREVENTING EQUIPMENT OF A SNORKEL

(75) Inventor: Pan Chen-Lieh, Ilan Hsing (TW)

(73) Assignee: QDS Injection Molding, LLC, San Diego, CA (US)

( * ) Notice: Subject to any disclaimer, the term of this patent is extended or adjusted under 35 U.S.C. 154(b) by 0 days.

(21) Appl. No.: 09/948,607

(22) Filed: Sep. 10, 2001

(65) Prior Publication Data

US 2003/0047182 A1 Mar. 13, 2003

(51) Int. Cl.[7] ..... B63C 11/16

(52) U.S. Cl. ..... 128/201.11; 128/200.29; 128/201.26; 128/201.27; 128/201.28

(58) Field of Search ..... 128/200.29, 201.11, 128/201.27, 201.28; 138/89; 493/962; 137/527.6

(56) References Cited

U.S. PATENT DOCUMENTS 5,004,010 A * 4/1991 Huet ..... 137/513.3
5,267,556 A * 12/1993 Feng ..... 128/201.11
5,280,785 A * 1/1994 Fujima ..... 128/201.11
5,404,872 A * 4/1995 Choi ..... 128/201.11
5,865,169 A * 2/1999 Lan et al. ..... 128/201.11
5,960,791 A * 10/1999 Winefordner et al. . 128/201.11
6,073,626 A * 6/2000 Riffe ..... 128/201.11
6,085,744 A * 7/2000 Hermansen et al. ... 128/201.11
6,129,081 A * 10/2000 Wu ..... 128/201.11
6,202,644 B1 * 3/2001 Takeuchi et al. ..... 128/201.11
6,234,195 B1 * 5/2001 Kippe et al. ..... 137/493.3
6,240,957 B1 * 6/2001 Hattori ..... 137/515
6,264,452 B1 * 7/2001 Sun et al. ..... 137/527.4
6,276,362 B1 * 8/2001 Chen-Lieh ..... 128/201.11
6,371,108 B1 * 4/2002 Christianson ..... 128/200.29

* cited by examiner

*Primary Examiner*—Weilun Lo
*Assistant Examiner*—Michael G. Mendoza
(74) *Attorney, Agent, or Firm*—Troxell Law Office PLLC

(57) ABSTRACT

The present invention relates to a water preventing equipment fo a snorkel, that attaches to the end of a snorkel, which includes an embodiment and a cover. The embodiment contains a first room and a second room, which is divided by a baffle. The first room connects to the conduit. The cover is located above the end opening and it is an active structure that can flip up and down. The cover covers the end opening and is located above the first room. By using this active cover, this equipment can easily prevent large amounts of water from splashing into the conduit, and can still remain the smoothness of the airway for exhaling water and exhausting air.

3 Claims, 3 Drawing Sheets

WATER PREVENTING EQUIPMENT OF A SNORKEL

FIELD OF THE INVENTION

Floating divers and swimmers use the snorkel as a means to breathe while swimming face down on the water surface. The snorkel functions as a conduit between the diver's mount and the overhead air.

BACKGROUND OF THE INVENTION

Swimmers and divers use snorkels to breathe while their face is facing downward under the water. In a conventional snorkel, the opening at the top end thereof is only about 10~15 cm above the water level when the diver is floating. The tail end communicates with the diver's mouth. When the divers heads are sloped so that the snorkel is inclined, or a wave on the water surface may cause water to flow into the snorkel and to the mouth, undetected water can be inhaled resulting in coughing and extreme discomfort. Upon surfacing, the diver must clear the snorkel by a blast of exhaled air, which forces the remaining water back out through the upper end of the snorkel (or by other various device to exhaust the water from the snorkel).

If the route of the water were not smooth enough while the diver exhausts the water from the snorkel by exhaling air, some water would probably run back. This kind of situation might cause coughing if the amount of water that ran back was too much. If just a little amount, then it would not affect the normal breathing method, also the rest of the water would be forced out by several times of breathing.

There are several kinds of inventions designed to prevent from large amount of water entering the snorkel, like U.S. Pat. Nos. 4,805,610, 5,092,324, 5,280,785, 6,129,081, 6,073,626 . . . etc. The applicant thought that this kind of water entering preventer should meet several requirements:

1. Air way must be smooth. It is important that the amount of air for breathing not be decreased because of the structure.
2. The air and water must be able to enter or exit the conduit easily. It is important that water and air not to run back to the conduit because of the structure of the attachment.
3. The structure of the attachment should not be too complicated; otherwise the producing fee would be too high.

However, the applicant believes that the previous inventions mentioned above could not meet the requirements above.

SUMMARY OF THE INVENTION

The object of the present invention is to provide an attachment of a snorkel, which prevents from water getting in. The structure contains an active cover. This cover naturally lays on the opening of the conduit, preventing water from entering the conduit, and it can also make good affect on forcing the water out, exhaling air and exhausting air.

The other object of the present invention is that the active cover can automatically cover a part of the opening by using its own weight. On the other hand, when the conduit is exhaling air or water, the cover would flip open easily by itself. Therefore, enlarge the size of the opening of the conduit, which can exhale a large amount of water and air.

The other object of the present invention is to construct a larger opening on the top of the attachment. The active cover covers part of the opening, so that the water would not splash into the conduit. On the other hand, it provides a larger opening for air, which would make the diver easier to breathe.

The other object of the present invention is to provide a better path to exhale water. The reason is that this invention contains a larger space for water storing.

Another object of this invention is to provide a higher shield so that the splashed water would be harder to enter the conduit.

DETAILED DESCRIPTION OF THE INVENTION

Figure 1:
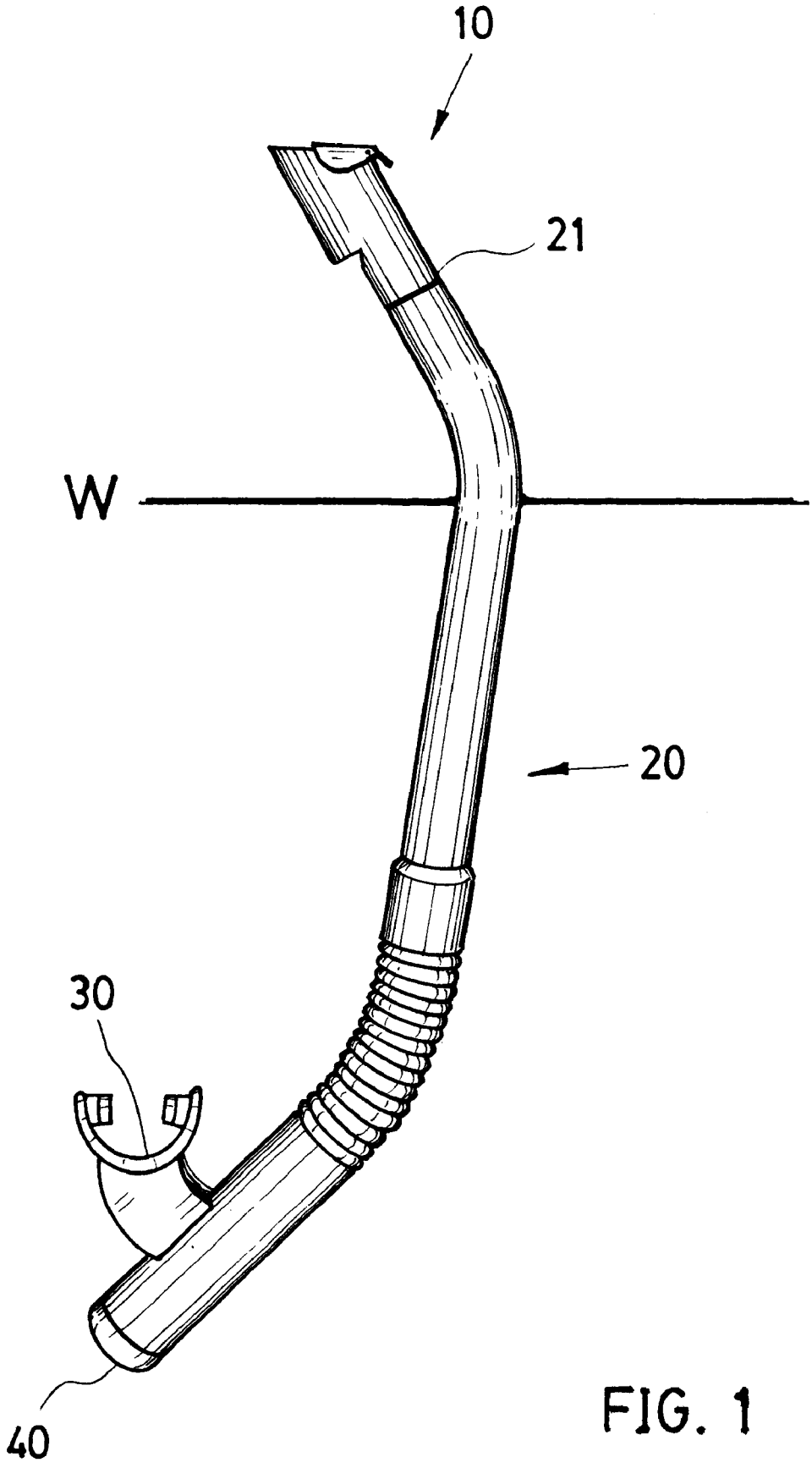
FIG. 1: A perspective view of the present invention, showing an attachment attaching on a conduit.

Referring to FIG. 1, it is a snorkel attached with the water preventing equipment 10 of the present invention. Except the water preventing equipment 10, the present invention also contains a conduit 20, a mouthpiece 30, and a purge valve 40 below the mouthpiece 30. The present invention is mainly an improvement of the water preventing equipment 10, as to the conduit 20, mouth piece 30 and the purge valve 40 are just the same as what people usually use. At the opening 21 on the top of the conduit 20, we construct this water preventing equipment 10; the letter "W" in the figure represents the level of water.

Figure 2:
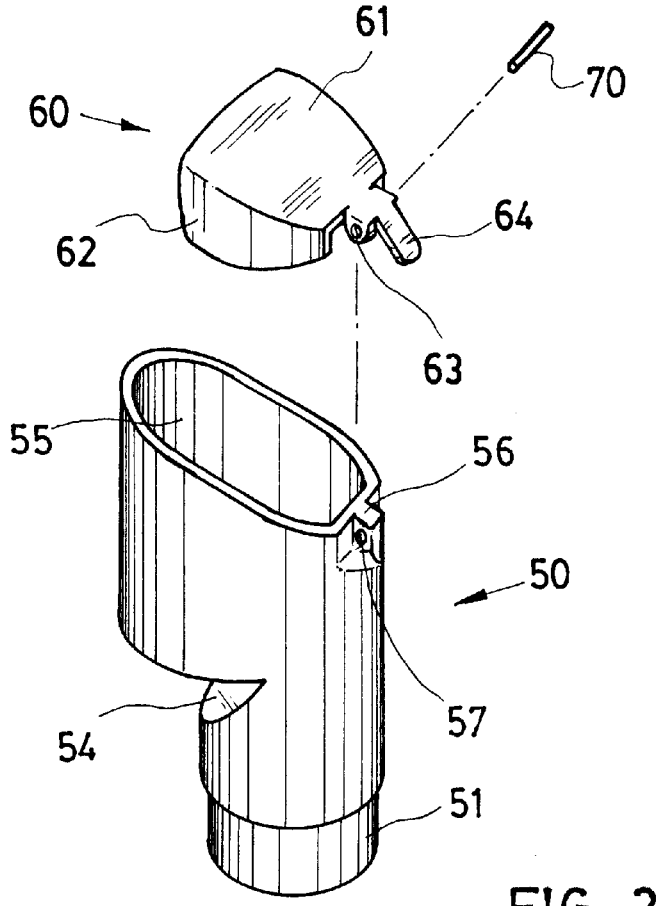
FIG. 2: The exploded view of the present invention.
Figure 3:
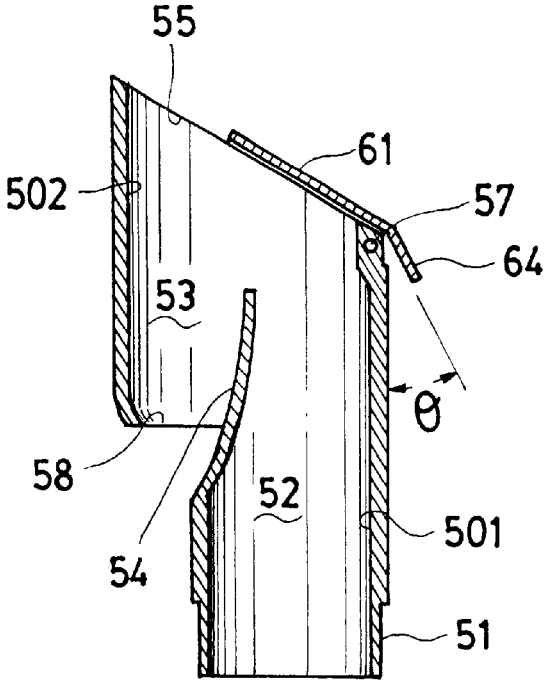
FIG. 3: The cross-sectional view of the present invention (1)
Figure 4:
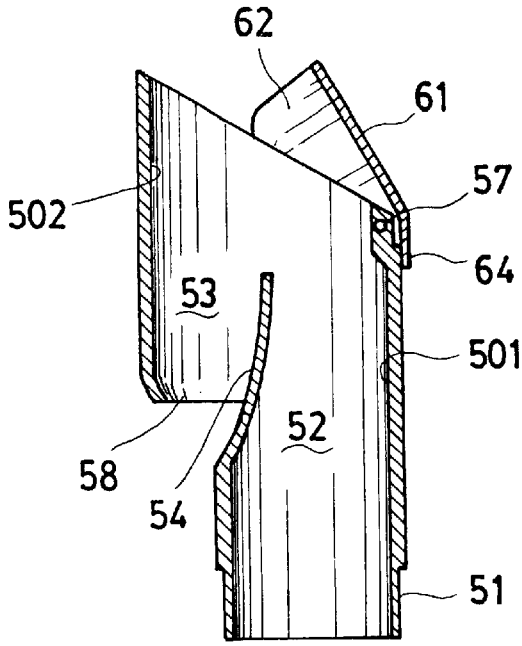
FIG. 4: The cross-sectional view of the present invention (2)

Referring to FIGS. 2–4, it is the water preventing equipment 10 of the present invention. Its structure includes a tubular embodiment 50, the active cover 60 and the pin 70.

The structure of the embodiment 50 includes a plugging part 51, which attaches to the top opening 21 of the conduit 20. The first room 52, the second room 53, and the baffle 54 are located inside the embodiment 50. On the top of the embodiment 50, there is a sloped end opening 55. At the lower part of the opening 55, a plug 56 is constructed. A horizontal hole 57 is constructed at the middle of the plug 56. Also, an opening 58 is constructed below the second room 53.

The active cover 60 is a structure constructed at the end opening 55 on the embodiment 50. It contains a top cover 61, a side cover 62, a pair of plugging hole 63 and a resistor 64; The top 61 and the side cover 62 forms a flat object covering on part of the end opening 55 on the top of the embodiment 50. The plugging hole 63 is located at the outside of the hole 57; the resistor is the continuation of the top cover 61.

The pin 70 goes through the plugging hole 63 and the hole 57, which allows the active cover 60 to attach on the embodiment 50. By using the pin 70 as an axis, the active cover 60 can therefore rotate by a certain angle θ.

The tube wall 501 and the baffle 54 of the embodiment 50 form the first room 52. The first room 52 is connected to the room in the conduit, which the top opening of the first room 52 is below the top cover 61 of the active cover 60.

The tube wall 502 and the baffle 54 of the embodiment 50 form the second room 53. The end opening 55 is at the top of the second room 53; the bottom part belongs to the opening 58. While water enters from the end opening 55, it can be exhaled through the opening 58. However, if not all the water exited the conduit, it will be stored in the second room 53 and to be exhaled later.

The baffle 54 divides the first room 52 and the second room 53. There is a certain distance between the top of the baffle 54 and the top cover 61, so that fresh air can flow through the first space 52 and the end opening 55.

Part of the end opening 55 is covered by the top cover 61. The top cover 61 is located at the end opening 55, and the side cover 62 is located at top outer part of the embodiment 50. When the cover 60 is flipped open, the side cover 62 would still form a closed section at the side of the end opening 55. Referring to FIG. 4, we can see that there is a certain degree θ between the resistor and the embodiment 50. Therefore, when the resistor 64 is flipped up to a certain height, it would naturally stock at the embodiment 50. This way the active cover 60 can still lays back down by its own weight.

By using the strength of the air and water exhaled from the conduit 20, the active cover 60 can be flipped up. The active cover 60 can actually be flipped open by just a small strength, and when the active cover 60 is flipped open, it would form a larger opening, so the air and water can easily exit the conduit.

Since the area of the top coves 61 and side cover 62 covers is larger then the area above the first room 52, the water splashed over the top of the water preventing equipment 10 would therefore enter the second room 53 from the end opening 55.

While the driver inhales air, the air will go through the end opening 55 and the top of the baffle 54, and then enters the first room 52, further on to the conduit 52.

When water runs into the second room 53 from the opening 58, the level of water would have to be higher than the baffle 54 to enter the first room 52.

Figure 5:
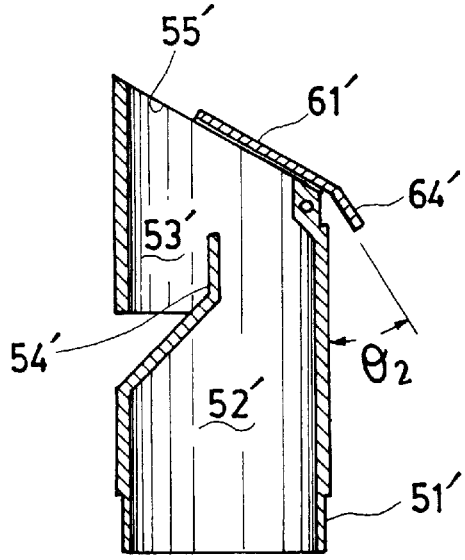
FIG. 5: Another perspective of another embodiment view of the present invention.

Referring to FIG. 5, the structure shown is easier than the structure shown in FIGS. 2~4. By using the plugging part 51', the water preventing equipment 10 can plug into the conduit 20. The first room 52' and the second room 53' is divided by the baffle 54'. The top cover 61' is placed above the end opening 55'. There is a certain default degree $\theta_2$ between the resistor 64' and the embodiment 50. The second room 53' described above would be smaller than the previous setting, but it can still achieve the function designed.

In conclusion, although the structure of this water preventing equipment 10 is quite simple, by using the active cover 60, the amount of water entering the snorkel can actually be decreased. Also by achieving the goal of exhaling water and air, the present invention is truly an improvement of the traditional model.

The method of constructing the active cover 60 on the embodiment 50 does not only apply to the method described above. There are more ways to construct the active cover 60 on the embodiment 50 and achieve the goal of having the cover active.

The active cover 60 would not only limit to the shape described above. As long as it is an active cover, which contains an end opening 55, the goal can be achieved.

As the description above, this invention does not limit to just the shape and method described above. According to the law of patent, any method and structure of a water preventing equipment similar to the present invention should belong to the claim of the present invention.

What is claimed is:

1. A water preventing device for a snorkel comprising:

a first tubular housing having an upper end with a first opening and a lower portion including a plugging part;

an interior baffle dividing the tubular housing into a first room and a second room, an upper edge of the baffle located below the upper end of the housing, the second room having a second opening; and a cover pivotally connected to the upper end of the housing so as to be movable between closed and open positions, the cover including a top cover, a side cover depending from the top cover and a resistor, whereby the resistor extends outwardly from the cover so as to contact an outer side of the tubular housing when the cover is in the open position so as to prevent further opening of the cover.

2. The water preventing device of claim 1 wherein the top cover only partially covers the first opening when in the closed position.

3. The water preventing device of claim 1 wherein the side cover extends below the upper end of the housing when the cover is in the open position.

* * * * *